US008033868B2

(12) United States Patent
Wang et al.

(10) Patent No.: US 8,033,868 B2
(45) Date of Patent: Oct. 11, 2011

(54) ELECTRICAL CONNECTOR WITH A TONGUE

(75) Inventors: Hong-Wu Wang, Kunshan (CN); Hong-Qiang Han, Kunshan (CN); Lun-Song Hu, Kunshan (CN); Zi-Qiang Zhu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 102 days.

(21) Appl. No.: 12/548,734

(22) Filed: Aug. 27, 2009

(65) Prior Publication Data

US 2010/0055986 A1 Mar. 4, 2010

(30) Foreign Application Priority Data

Aug. 27, 2008 (CN) ..... 2008 2 0041481 U
Aug. 27, 2008 (CN) ..... 2008 2 0041485 U

(51) Int. Cl.
*H01R 12/00* (2006.01)
*H01R 13/405* (2006.01)

(52) U.S. Cl. ..... 439/660; 439/701; 439/892; 439/954

(58) Field of Classification Search ..... 439/660, 439/736, 701, 954, 892
See application file for complete search history.

(56) References Cited

U.S. PATENT DOCUMENTS 4,775,333 A * 10/1988 Grider et al. ..... 439/736
4,865,562 A * 9/1989 Burg et al. ..... 439/395
5,073,130 A * 12/1991 Nakamura ..... 439/607.32
5,137,462 A * 8/1992 Casey et al. ..... 439/74
5,269,692 A * 12/1993 Takahashi ..... 439/74
5,382,168 A * 1/1995 Azuma et al. ..... 439/65
5,597,324 A * 1/1997 Katsunori ..... 439/587
5,934,942 A * 8/1999 Patel et al. ..... 439/607.5
5,975,917 A * 11/1999 Wang et al. ..... 439/79
6,093,046 A * 7/2000 Chiou et al. ..... 439/378
6,210,218 B1 * 4/2001 Chang ..... 439/567
6,402,552 B1 * 6/2002 Wagner ..... 439/606
6,447,310 B1 * 9/2002 Brown ..... 439/108
6,561,821 B1 * 5/2003 Yu ..... 439/74
6,648,697 B2 * 11/2003 Yang ..... 439/701
6,685,486 B1 2/2004 Zhang et al.
6,695,622 B2 * 2/2004 Korsunsky et al. ..... 439/65
6,743,053 B2 * 6/2004 Wu ..... 439/634
6,893,285 B1 * 5/2005 Chiang ..... 439/378
6,923,662 B2 * 8/2005 Sasame et al. ..... 439/79
6,979,228 B2 * 12/2005 Zhang ..... 439/660
7,351,106 B2 * 4/2008 Zhu et al. ..... 439/607.27
7,452,243 B2 11/2008 Wan et al.
(Continued)

*Primary Examiner* — Neil Abrams
(74) *Attorney, Agent, or Firm* — Wei Te Chung; Andrew C. Cheng; Ming Chieh Chang

(57) ABSTRACT

An electrical connector (100) including an insulative housing (1), a plurality of contacts (2) and a pair first insulators (22). The insulative housing (1) has a body portion (11) and a tongue (12) extending from the body portion (11). The tongue (12) defines a plurality of passageways (132) at two sides thereof. Each contact (21) has a securing portion (212), a contact portion (211) extending to the tongue (12) from the securing portion (212) and a tail portion (213) extending out of the insulative housing (1). The contact portions (211) are arranged in two rows and respectively located at two sides of the tongue (12). Each first insulator (22) is insert molded around the securing portions (212) corresponding to the contact portions (211) of each row. Each first insulator (22) has a first post (228) and a first recess (229) at an inner side thereof to engage with each other.

12 Claims, 15 Drawing Sheets

U.S. PATENT DOCUMENTS 7,811,131 B2 * 10/2010 Wang et al. ..... 439/607.35
7,824,220 B2 * 11/2010 Chen ..... 439/607.35
2007/0066141 A1 * 3/2007 Zhu et al. ..... 439/607
2010/0330849 A1 * 12/2010 Wang et al. ..... 439/701

* cited by examiner

ELECTRICAL CONNECTOR WITH A TONGUE

BACKGROUND OF THE INVENTION

1. Field of the Invention

The present invention relates to electrical connectors, more particularly to electrical connectors with a tongue.

2. Description of Related Art

With rapid development of the electronic industry, electrical connectors are employed widely with peripherals to transmit various signals with each other. As we know, the electrical industry trends to a miniature and high speed transmission direction, the space which the electrical connector occupies is less and less. Thereby, the electrical connector trends to a miniature and high speed transmission direction also. A conventional electrical connector usually comprises an insulative housing, a plurality of contacts installed in the insulative housing to electrically connect with a corresponding plug for transmitting signals with each other, and a metal shell covering the insulative housing. The insulative housing defines a plurality of contact passageways. In conventional methods for manufacturing the electrical connector, an inserting method is adopted to insert rows of contacts into the passageways of the insulative housing from a rear end. The contacts are then forced into the housing. The contacts are manufactured by means of stamping.

However, such an inserting method will damage the mechanical and electrical performance of the electrical connector. Especially in a miniature electrical connector, the contacts and contact passageways are arranged closely. Side walls of the contact passageways are weak. Since the contacts interferentially engage with the side walls of the contact passageways, the contacts may wear away surfaces of the side walls. Thereby, the adjacent contacts will contact with each other and adversely affect signal transmission.

Hence, an improved electrical connector is desired to overcome the above problems.

BRIEF SUMMARY OF THE INVENTION

According to one aspect of the present invention, an electrical connector defining a receiving opening to receive a corresponding plug, comprising: an insulative housing having a body portion and a tongue integrally extending from the body portion, the tongue defining a plurality of passageways at two sides thereof, the passageways extending through the body portion; a plurality of contacts retained in the insulative housing, each contact having a securing portion, a contact portion extending to the tongue from the secured portion and a tail portion extending out of the insulative housing, the contact portions of all the contacts being arranged in two rows and respectively located at two sides of the tongue; and a pair of first insulators retained in the body portion, each first insulator being insert molded around the securing portions corresponding to the contact portions of each row to form a contact module, each first insulator has at least a first post and a first hole at an inner side thereof to engage with each other.

According to another aspect of the present invention, an electrical connector defining a receiving opening to receive a corresponding plug, comprising: an insulative housing having a body portion and a tongue extending to the receiving opening, the body portion defining a receiving space, the tongue having a top end, a lower end opposite to the top end and two side ends, the lower end connecting with the body portion, the top end and two side ends being free to the receiving opening; and a pair of contact modules retained in the receiving space, each contact module having a plurality of contacts and a first insulator insert molded around the contacts, each contact having a contact portion extending beyond one end of the first insulator, and a tail portion extending beyond another end of the first insulator and out of the insulative housing, the contact portions of each contact module being arranged in a row, and the two rows of the contact portions in the pair of contact modules respectively located at two sides of the tongue.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
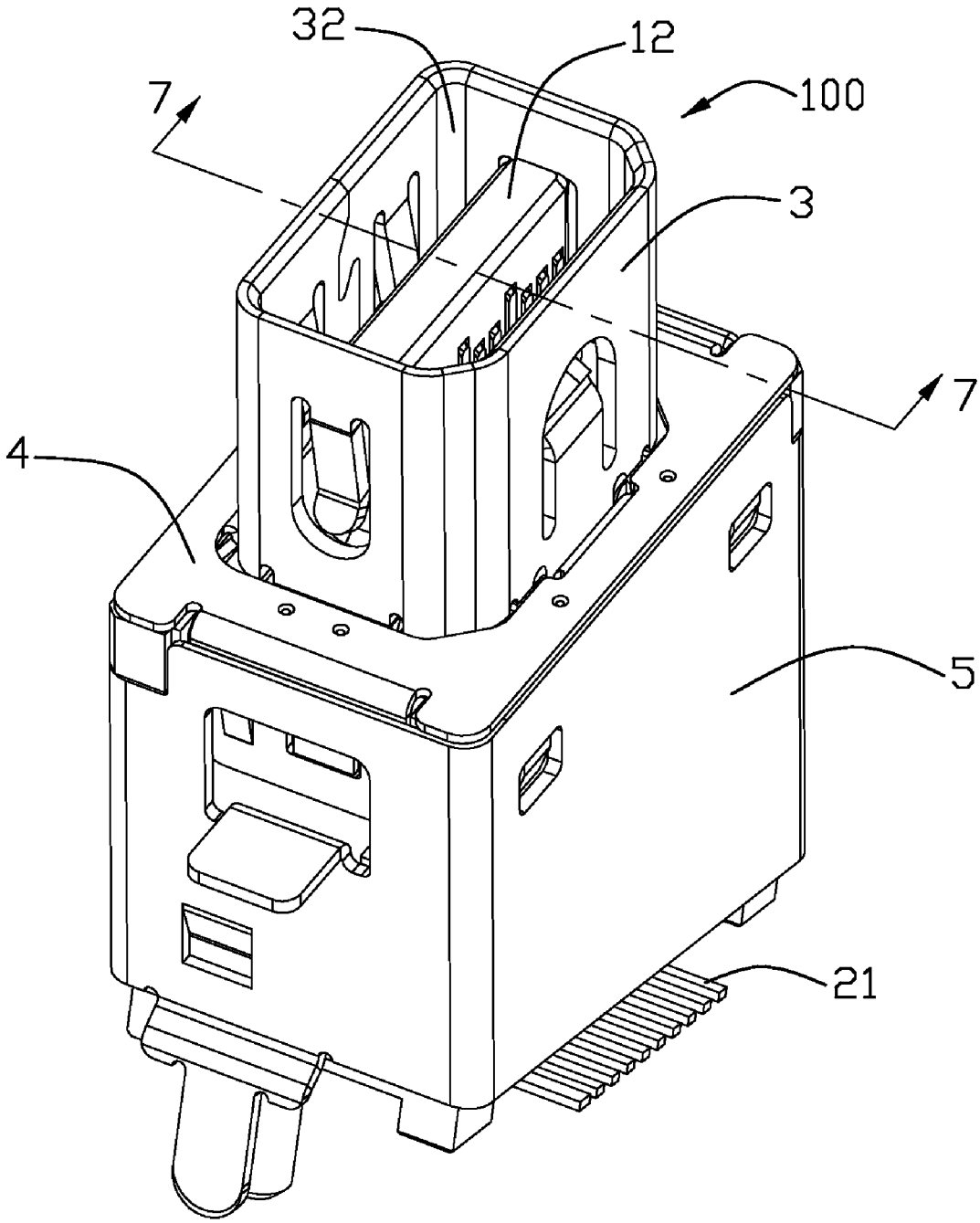
FIG. 1 is a perspective view of an electrical connector according to a first embodiment of the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
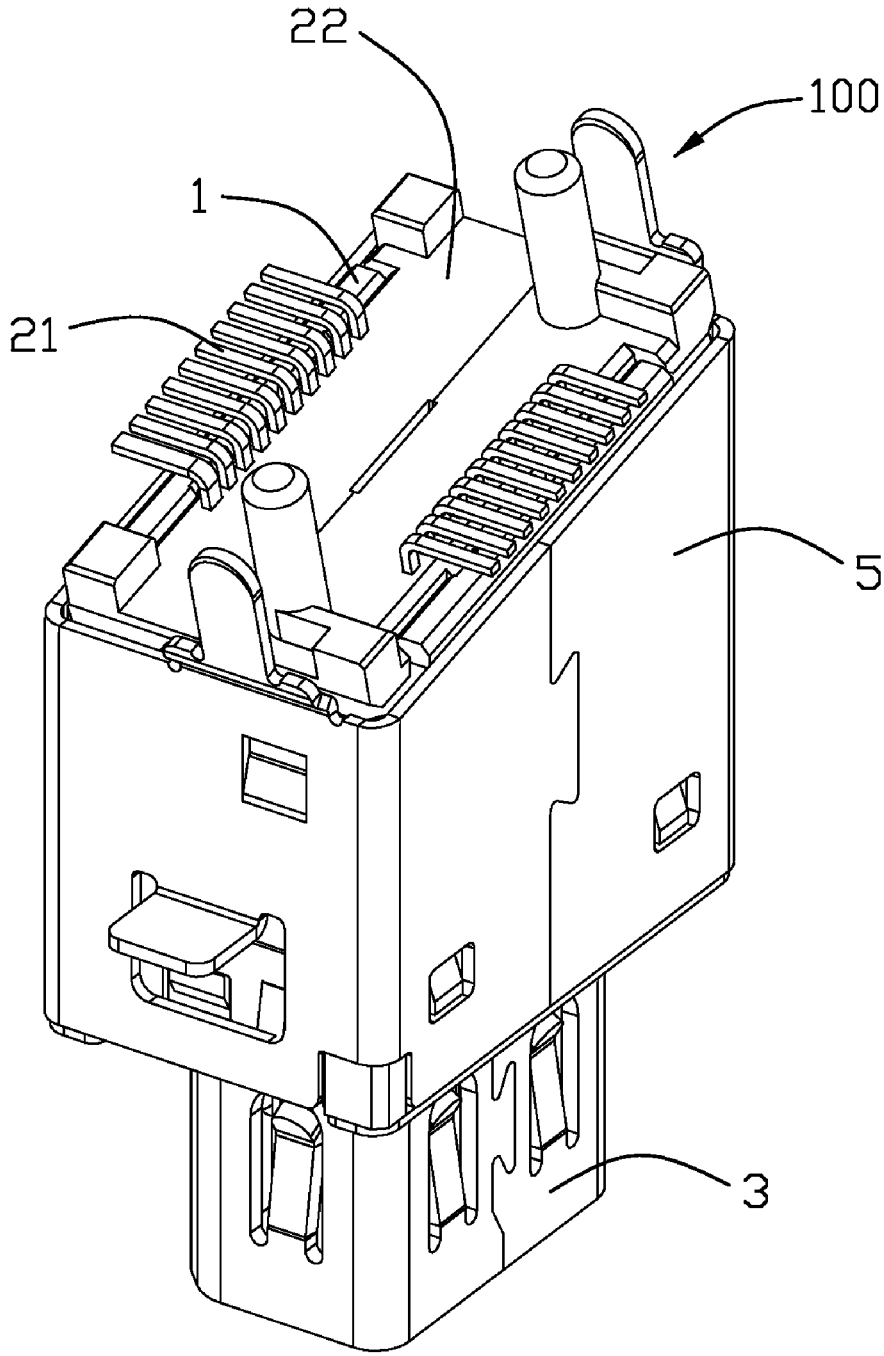
FIG. 2 is a view similar to FIG. 1, while taken from a different aspect.
Figure 3:
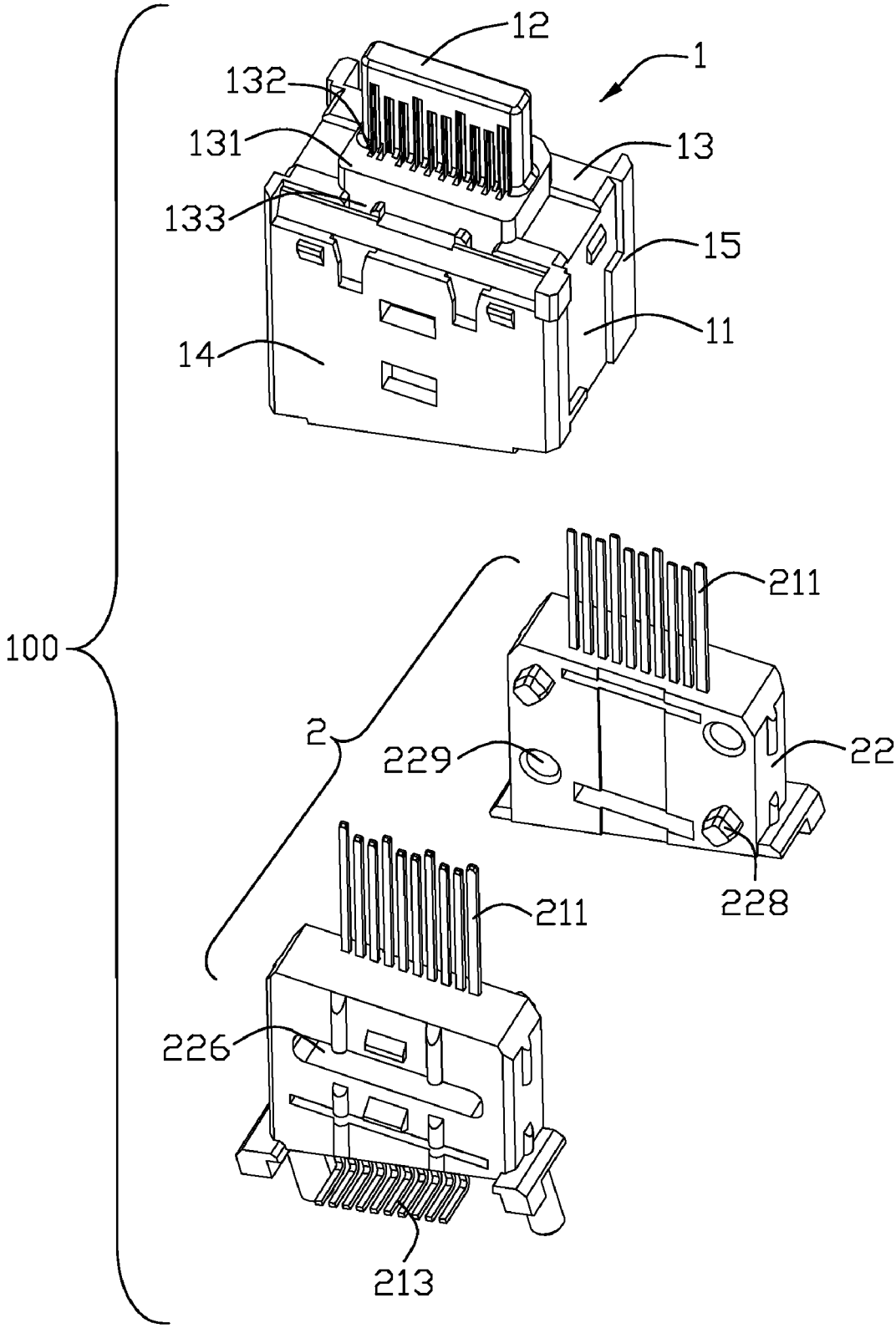
FIG. 3 is a perspective view of an insulative housing and a pair of contact modules of the electrical connector shown in the FIG. 1.
Figure 4:
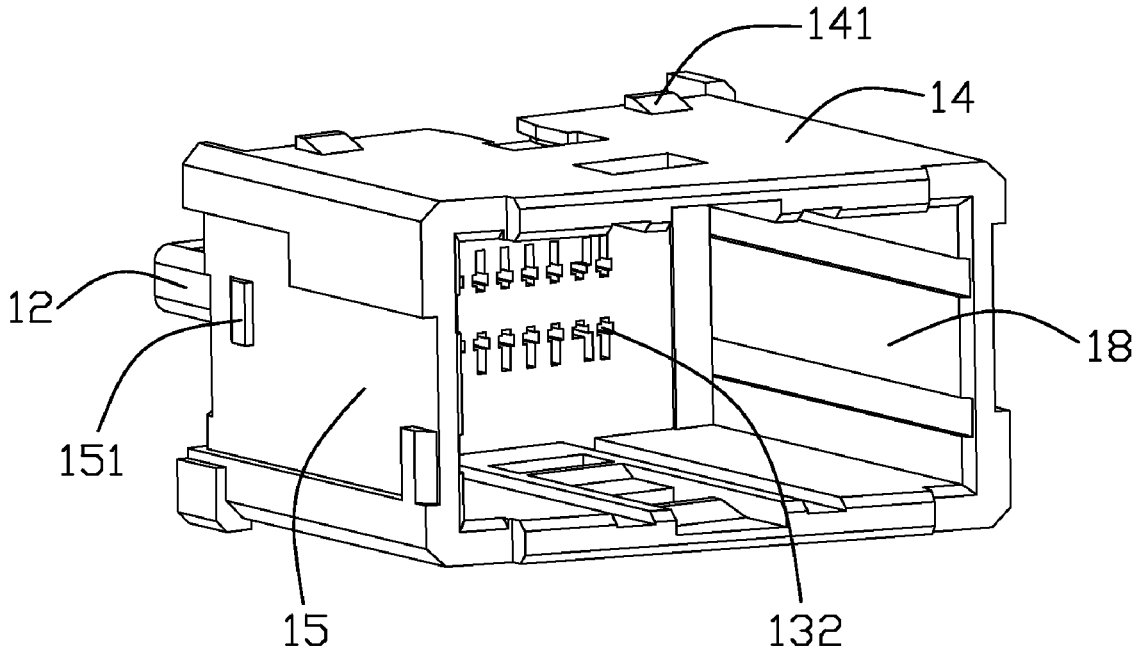
FIG. 4 is a perspective view of the insulative housing of the electrical connector shown in the FIG. 1.
Figure 5:
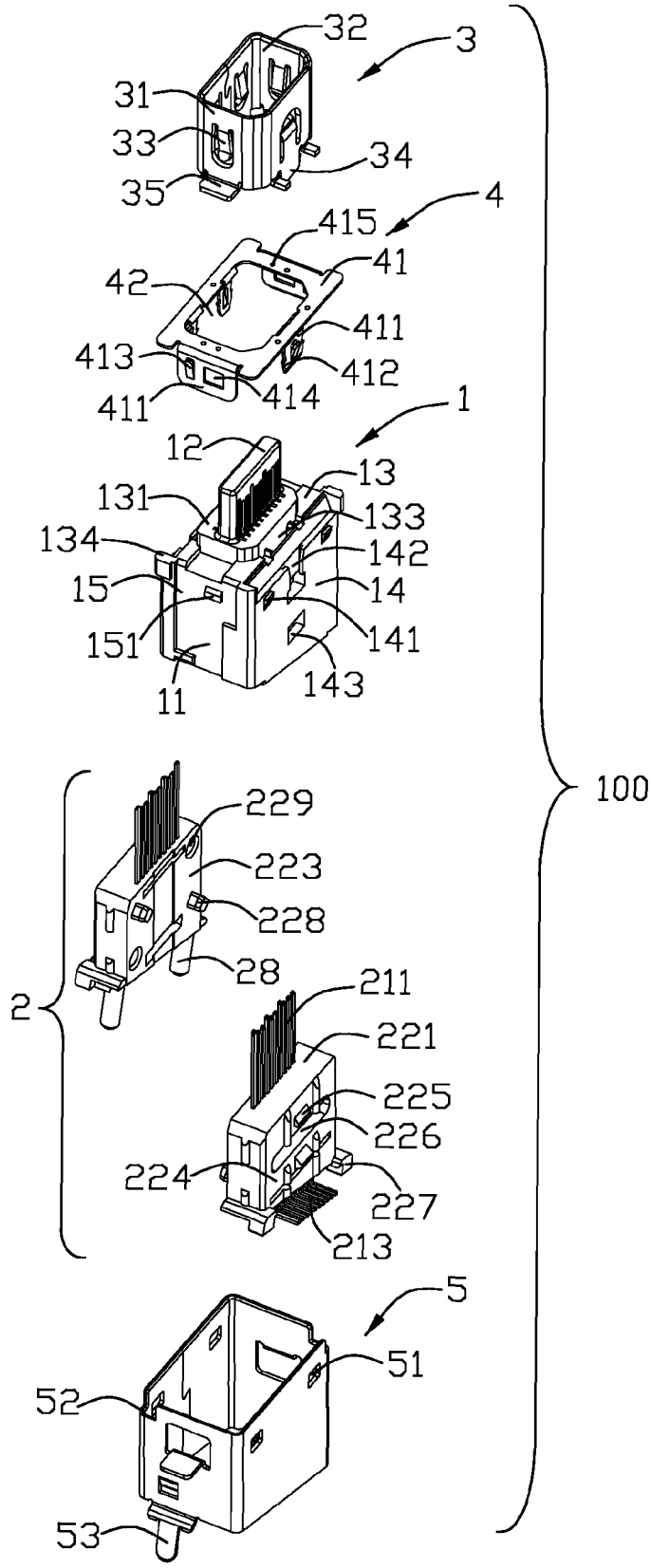
FIG. 5 is an exploded perspective view of the electrical connector shown in FIG. 1.
Figure 6:
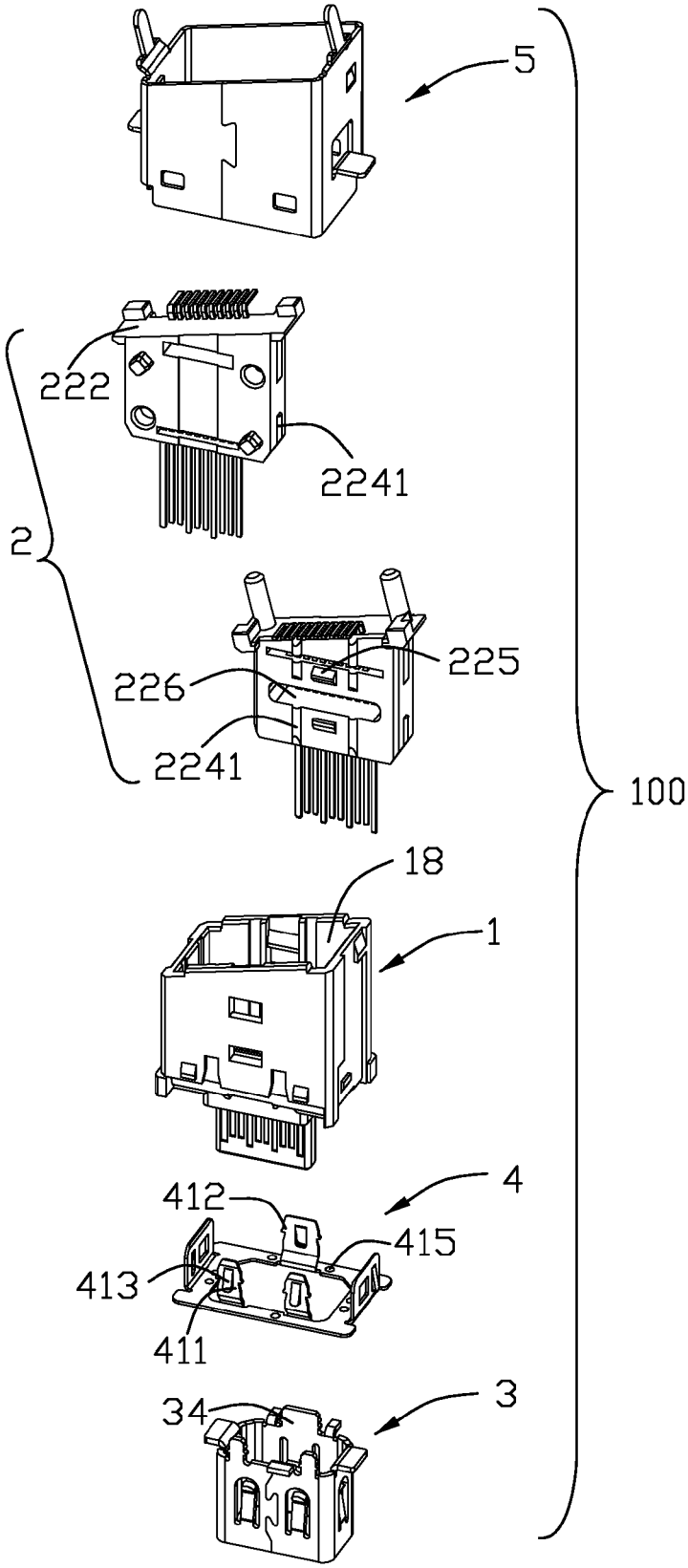
FIG. 6 is a view similar to FIG. 5, while taken from a different aspect.
Figure 7:
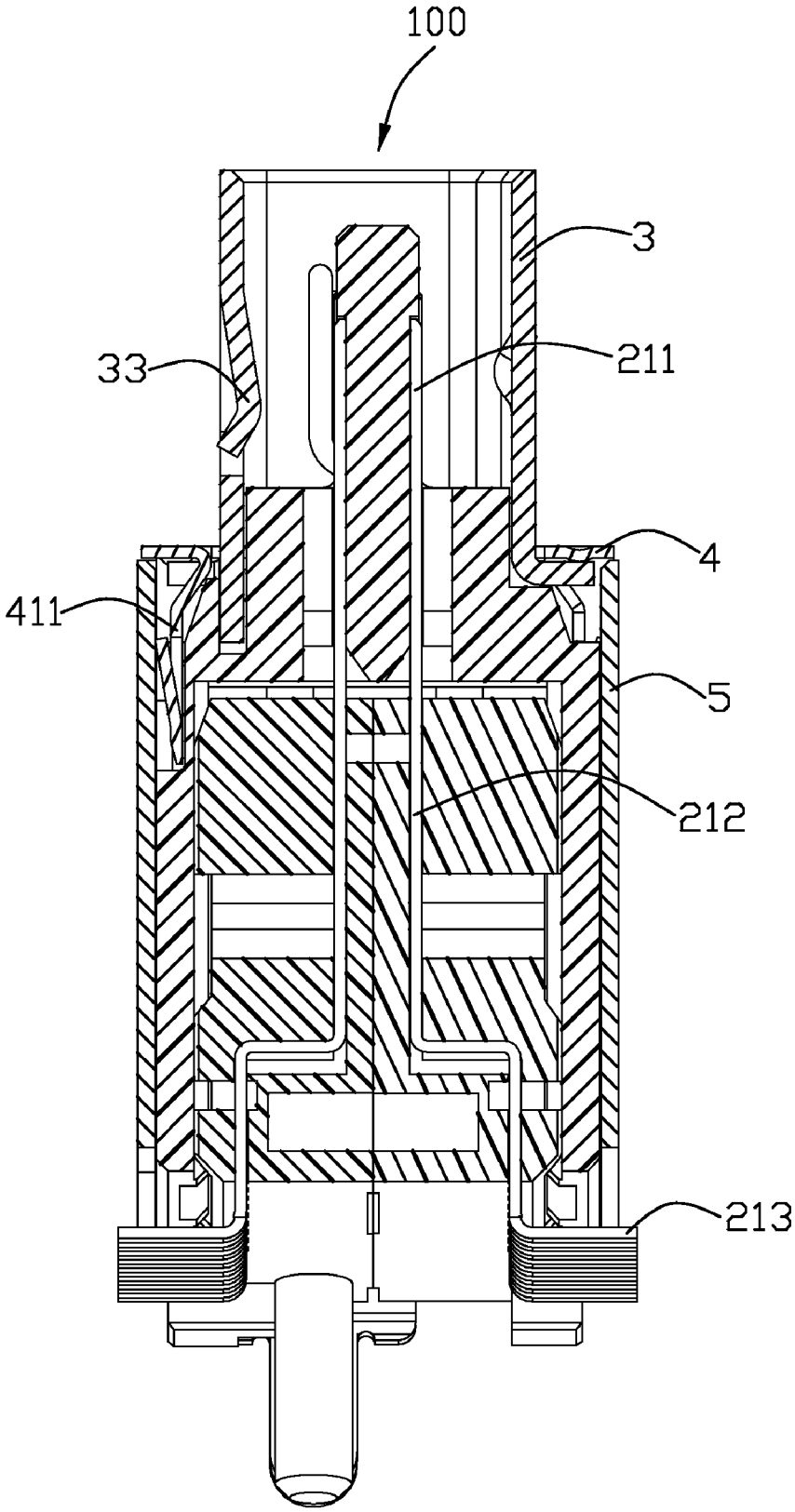
FIG. 7 is a cross-sectional view taken along line 7-7 of FIG. 1.

Referring to FIGS. 1-7, an electrical connector 100 according to a first embodiment of the present invention is disclosed. The electrical connector 100, 100' in the present invention is a Mini DisplayPort connector which comprises an insulative housing 1, a pair of contact modules 2 retained in the insulative housing 1, and a first shell 3, a second shell 4, and a third shell 5 engaging with each other and covering the insulative housing 1. The electrical connector 100 defines a receiving opening 32 for receiving a corresponding plug (not shown).

The insulative housing 1 has a body portion 11 and a tongue 12 extending upwardly from the base portion 10. The tongue 12 has four ends which comprise a lower end, a top end opposite to the lower end and a pair of side ends. There is only the lower end of the tongue 12 connects with the body portion 11, and the top end and two side ends of the tongue 12 are free to receiving opening 32. The body portion 11 has a mating wall 13 facing the receiving opening 32 and perpendicular to the tongue 12, and four side walls extending from four sides of the mating wall 13 along an inserting direction of the plug. The inserting direction of the plug is a first direction, and a direction opposite to the first direction is a second direction. A receiving space 18 is surrounded by the mating wall 13 and four side walls to receive the contact modules 2. The side walls comprise a pair of first side walls 14 parallel to the tongue 12, and a pair of second side walls 15 perpendicular to the tongue 12. The body portion 11 has an outstanding portion 131 with a transverse section smaller than that of the mating wall 13. The outstanding portion 131 presents as D-shaped.

The tongue 12 extends to the receiving opening 32 along the second direction from a middle position of the outstanding portion 131. The tongue 12 defines a plurality of passageways 132 extending through the body portion 11 along the first direction and communicating with the receiving space 18. The mating wall 13 defines a plurality of first slots 133 for fastening the first shell 3. The body portion 11 comprises a pair of first limiting block 134 extending outwardly from a diagonal position of the mating wall 13 for preventing the third shell 5 from moving upwardly. Each first side walls 14 has a pair of first locking blocks 141 and a pair of second slots 143 at an upper position thereof and arranged along a transverse direction, and a pair of openings 143 communicating with the receiving space 18 and arranged along the first direction. Each second side wall 15 has a second locking block 151 extending outwardly.

The two contact modules 2 are approximately symmetrical with each other, and a little difference between the two contact modules 2 is that one of contact modules 2 has a pair of position posts 28 for positioning the electrical connector 100 to a circuit board (not shown). The common characteristic will be described at following description.

Each contact module 2 comprises a row of contacts 21 and a first insulator 22 insert molding around the contacts 21. Each contact 21 has a securing portion 212, a contact portion 211 extending along the second direction and a tail portion 213 bending outwardly from the securing portion 212. The first insulator 22 is insert molded around the securing portion 212 for fastening the contacts 2 therein. The contact portions 211 extend beyond one end of the first insulator 22, and the tail portions 213 extends beyond another end of the first insulator 22. The contact portions 211 of one contact module 2 extend to the passageways 132 of one side of the tongue 12. Thereby, all the contact portions 211 of the contacts 2 are arranged in two rows and respectively located at two sides of the tongue 12. In molding process, fixing the contacts 2 in a mold (not shown) firstly; then inserting melting plastic to the mold, the melting plastic will be filled around the securing portions 212; finally, cooling the melting plastic, the first insulator 22 is formed and the contact module 2 is completely manufactured. Therefore, the contacts 2 can be arranged closely and the melting plastic can be filled in space between adjacent contacts 2 to separate them from each other for preventing the contacts 2 from contacting with each other.

The first insulator 22 has a mating face 221 abutting against an inner side of the mating wall 13, a mounting face 222 opposite to the mating face 221, an inner face 223 and an outer face 224 between the mating face 221 and the mounting face 222. The mating face 221 intersects with the mounting face 222 for mounting the electrical connector 100 to the circuit board along an oblique direction. The tail portions 213 are parallel to the mounting face 222 for mounting to the circuit board by a surface mounted technology. Each first insulator 22 has a pair of projections 225 extending outwardly from the outer face 224 to engage with the openings 143 for fixing the first insulator 22 to the receiving space 18. The first insulator 22 defines at least a groove 226 recessed from the outer face 224. The mold has a plurality of pins (not shown) located at the groove 226 and arranged between adjacent contacts 2 to separate the contacts 2 from each other, the contacts 2 will be prevented from contacting with each other as filling the melting plastic. The first insulator 22 has a plurality of second limiting blocks 227 abutting against a lower end of the insulative housing 1. Each first insulator 22 has a pair of posts 228 extending inwardly from the inner face 223 and a pair of recesses 229 recessed from the inner face 223 thereof. The two contact modules 2 are fixed with each other via the posts 228 and the recesses 229 engaging with each other. Each first insulator 22 has a plurality of ribs 2241 for engaging with inner sides of the first side walls 14 and the second side walls 15.

The first shell 3 is formed by a metal sheet, and comprises a plurality of outer walls 31, a plurality of engaging tabs 34 extending downwardly from a lower end of the outer walls 31, and a plurality of extension tabs 35 bending outwardly from the lower end of the outer walls 31. The receiving opening 32 is formed between the outer walls 31 and the tongue 12. Each outer wall 31 has at least one spring arm 33 extending to the receiving opening 32 for engaging with the plug. The engaging tabs 34 are received and fixed in the first slots 133. The extension tabs 35 affix to the mating wall 13.

The second shell 4 is formed by a metal sheet, and comprises a flat portion 41 affixing to the mating wall 13, a hole 42 extending through the flat portion 41 through which the first shell 3 extends, and a plurality of latch strips 411 bending downwardly from the flat portion 41. The latch strips 411 has a plurality of locking tangs 412 engaging with the second slots 142, a plurality of spring tabs 413 resisting to the third shell 5, and a plurality of apertures 414 engaging with the second locking blocks 151. The flat portion 41 has a plurality of embosses 415 extending downwardly for sandwiching the extension tabs 35 between the mating wall 13 and the flat portion 41.

The third shell 5 presents as a tube shape and rings on outside of the body portion 11. The third shell 5 has a plurality of locking holes 51 engaging with the first locking blocks 141, a pair of cutouts 52 receiving the limiting blocks 134 and a pair of mounting legs 53 fixing to the circuit board.

As fully described above, the two rows of contacts 21 are insert molded in two first insulators 22 respectively to form two contact modules 2. Thereby, the contacts 21 can be arranged closely and can not contact with each other. In addition, the contacts 21 need not assemble to the insulative housing 1 directly, the contacts 21 will not wear away surfaces of the inner walls of passageways 132.

Figure 8:
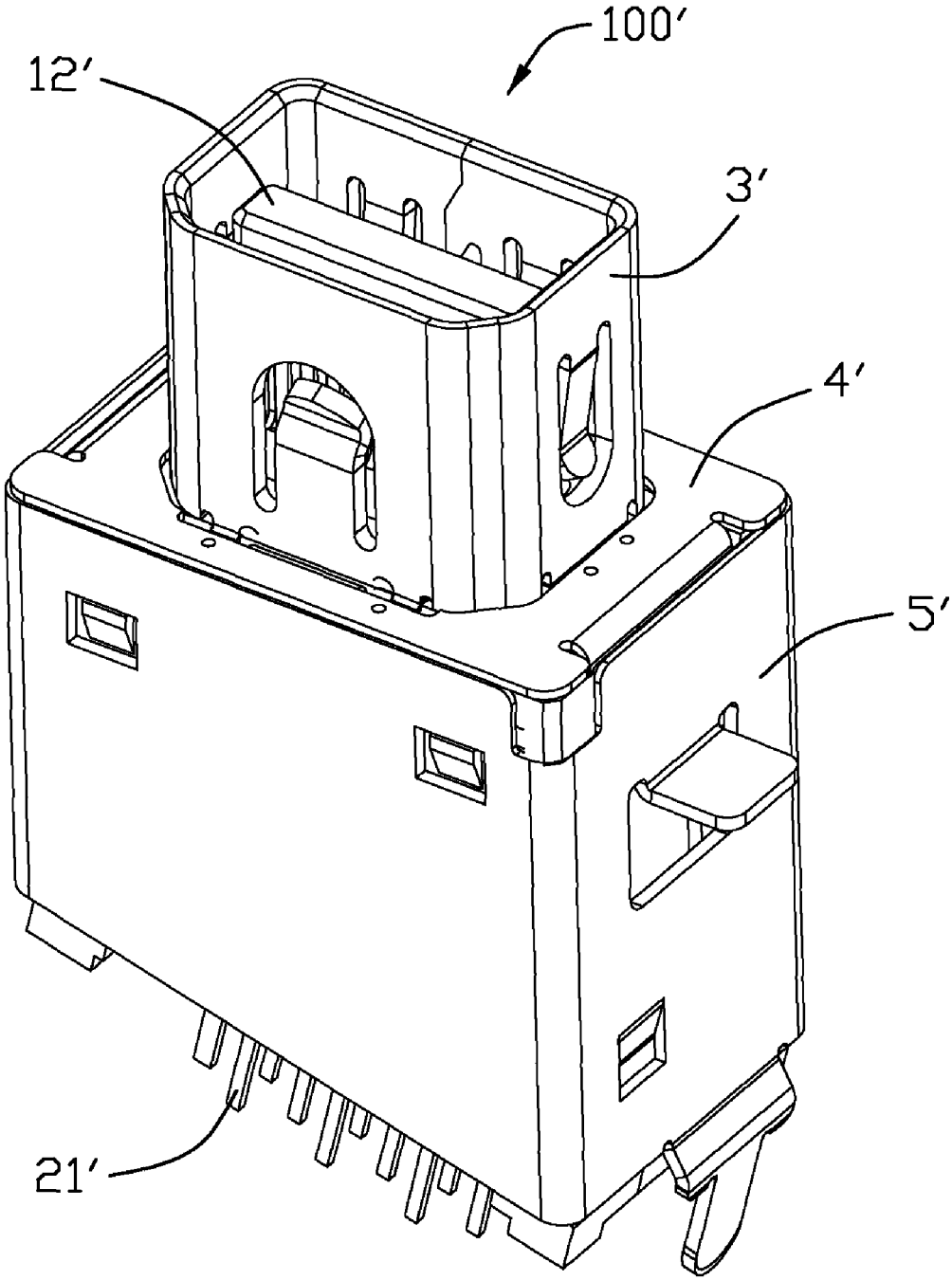
FIG. 8 is a perspective view of an electrical connector according to a second embodiment of the present invention.
Figure 9:
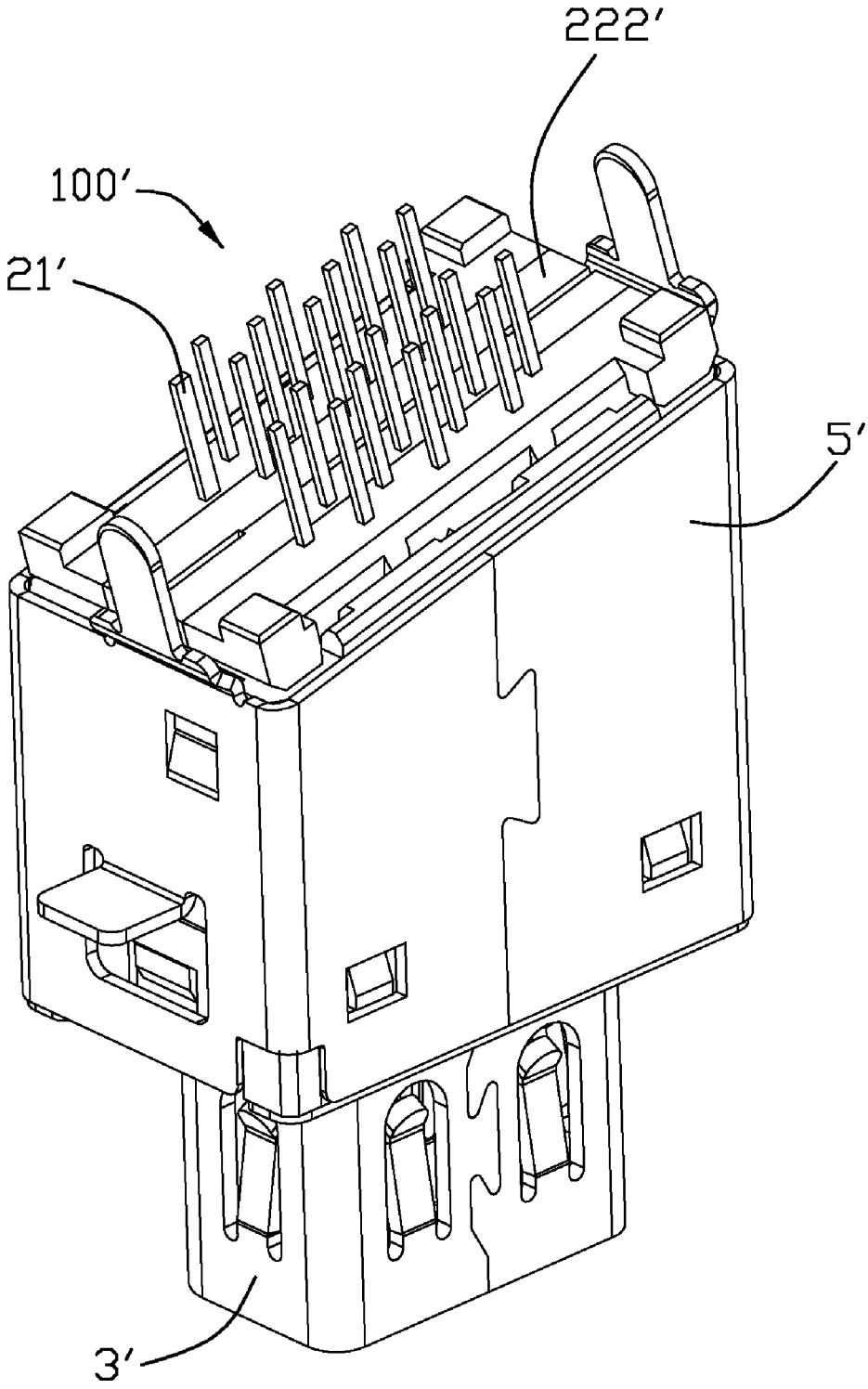
FIG. 9 is a view similar to FIG. 8, while taken from a different aspect.
Figure 10:
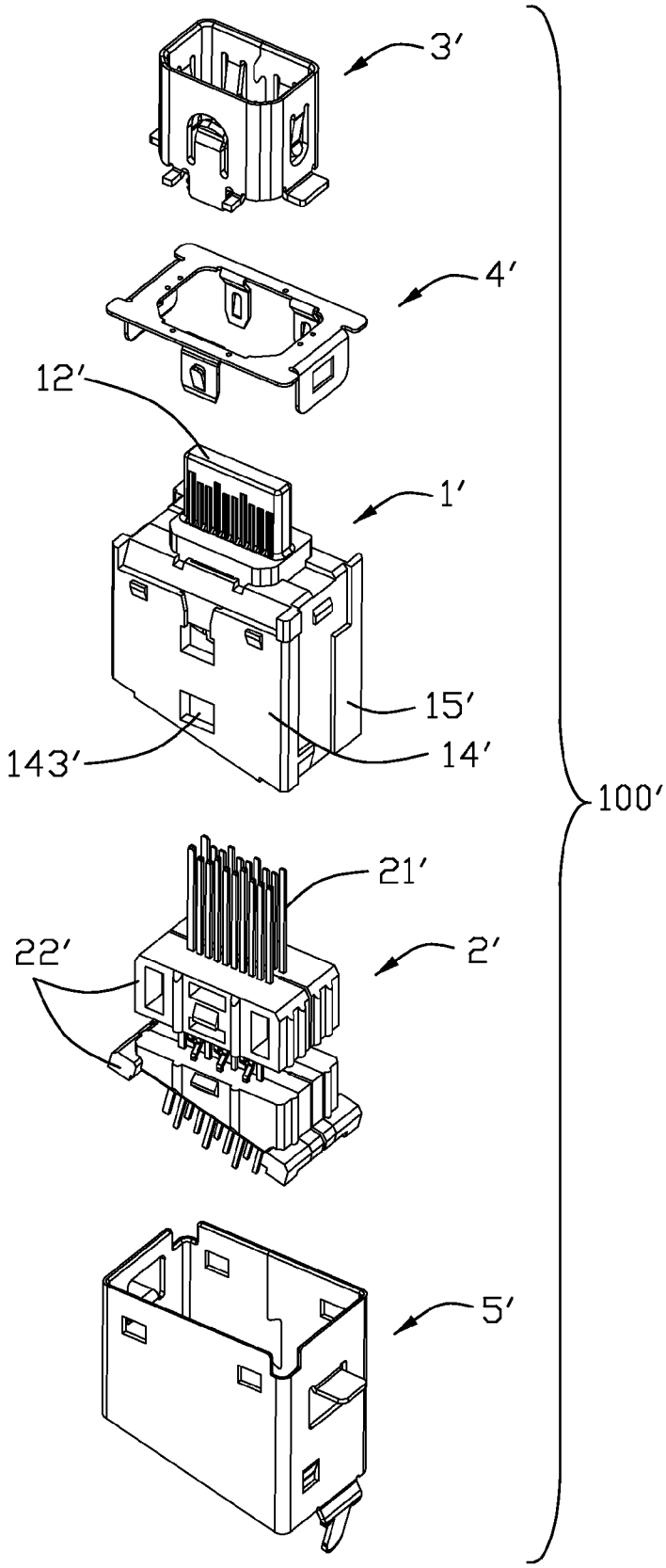
FIG. 10 is a partly exploded perspective view of the electrical connector shown in FIG. 8.
Figure 11:
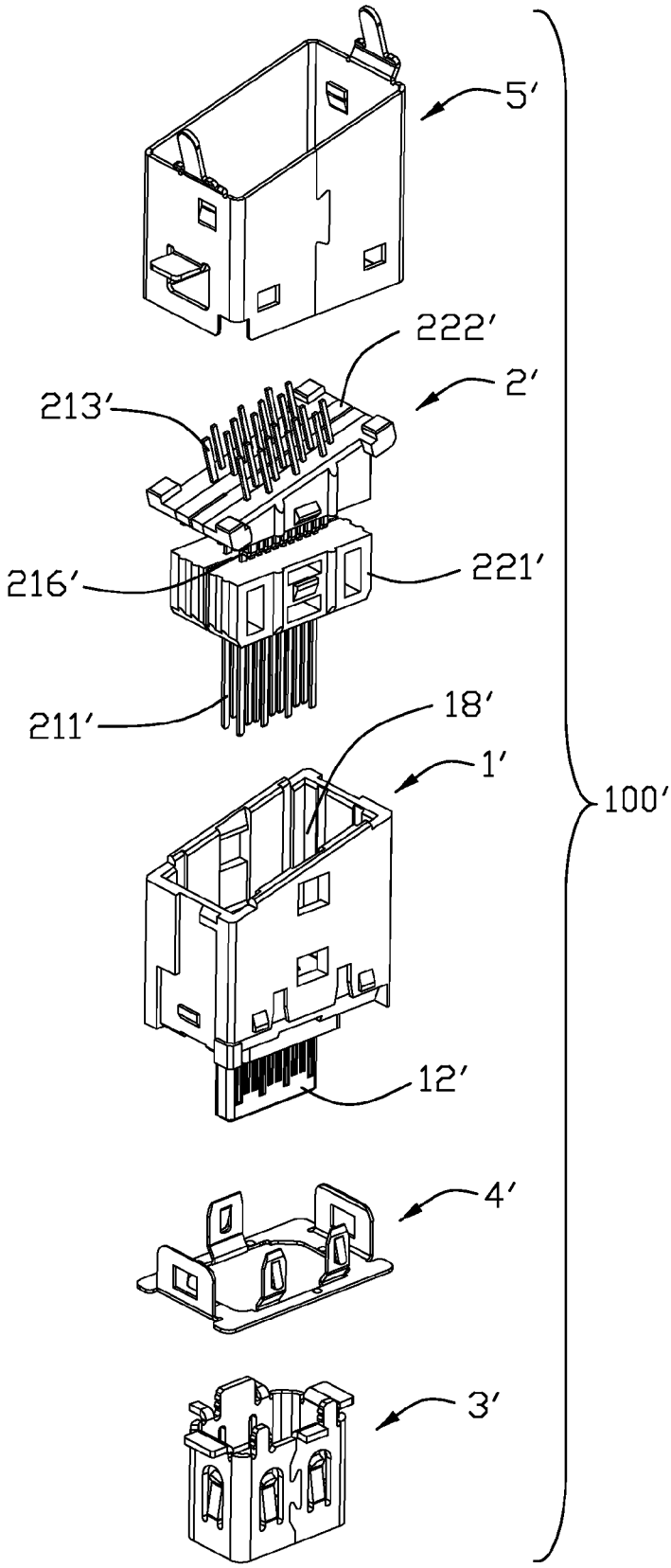
FIG. 11 is a view similar to FIG. 10, while taken from a different aspect.
Figure 12:
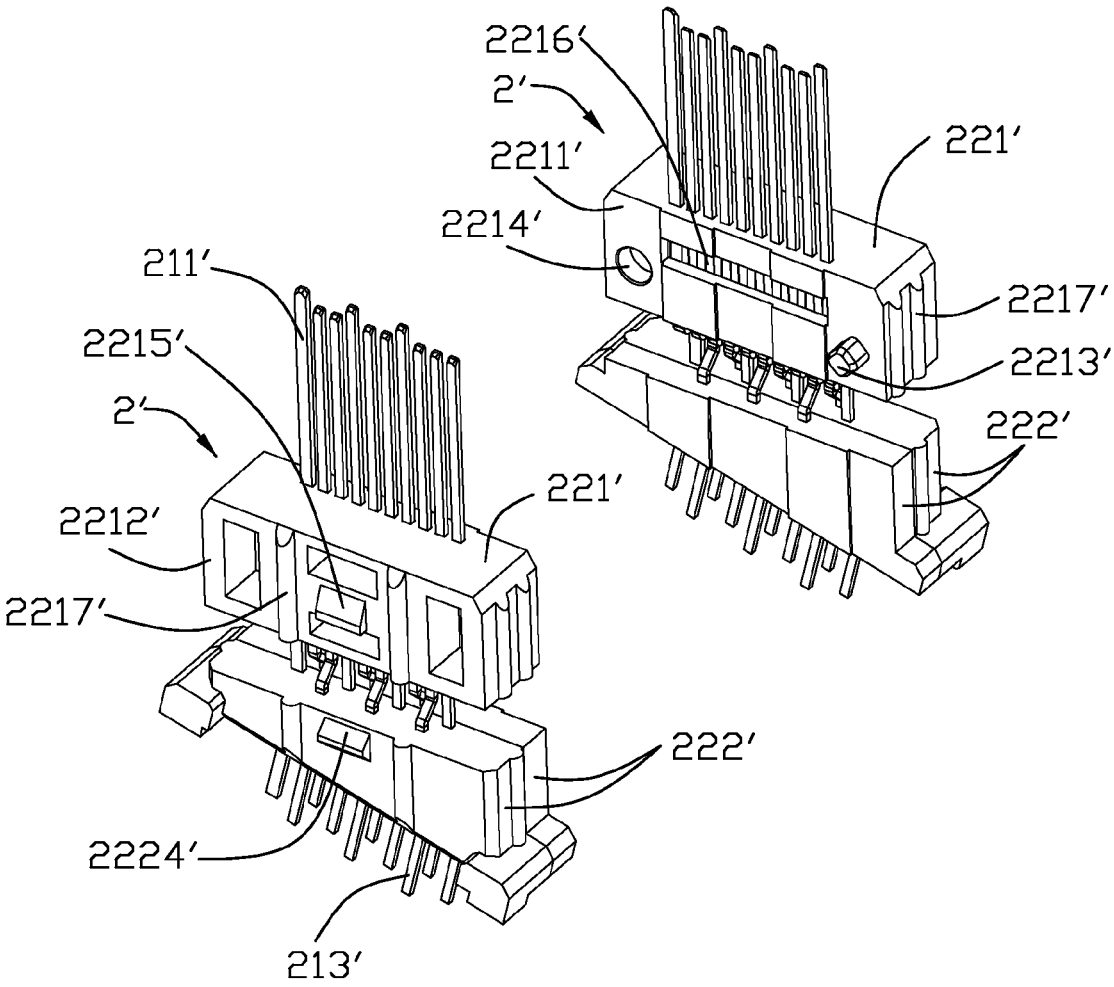
FIG. 12 is a perspective view of a pair of contact modules of the electrical connector shown in FIG. 8.
Figure 13:
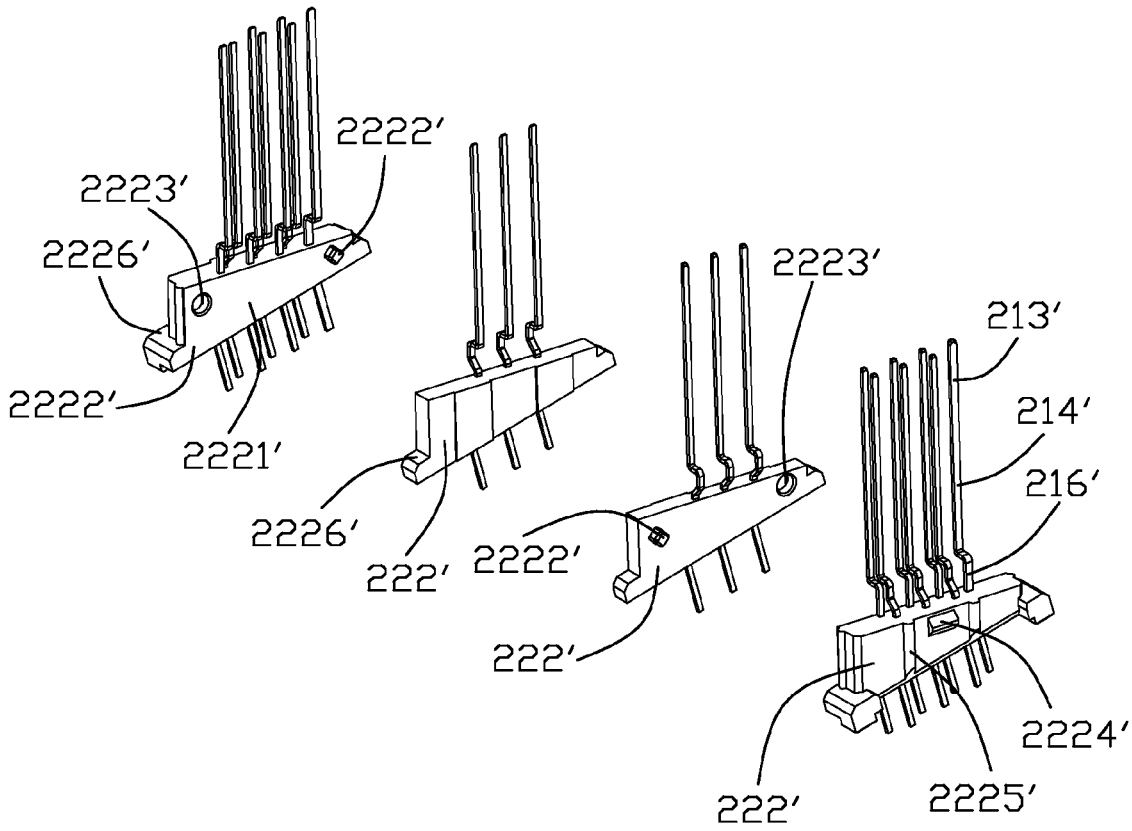
FIG. 13 is a partly exploded view of the contact modules of the electrical connector shown in FIG. 8.
Figure 14:
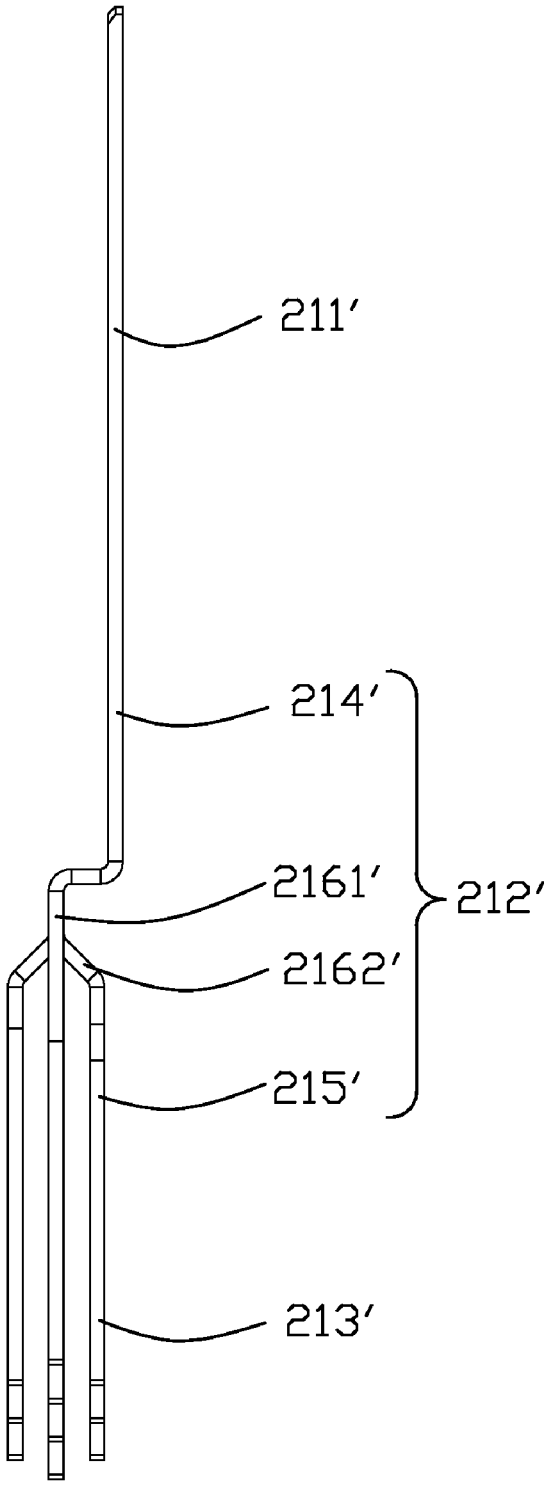
FIG. 14 is a left side elevational view of a plurality of contacts of the electrical connector shown in FIG. 8.
Figure 15:
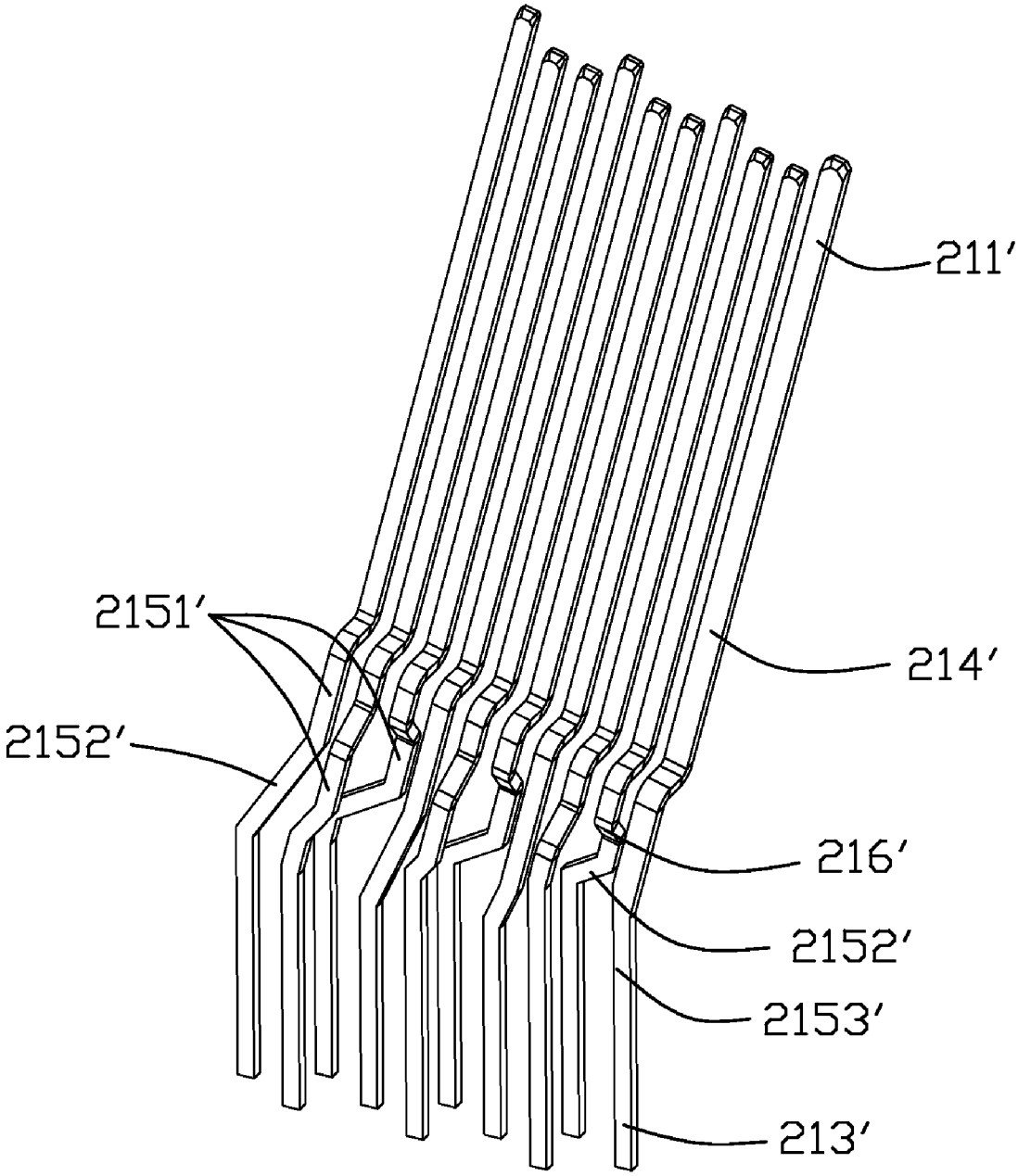
FIG. 15 is a perspective view of the contacts shown in FIG. 14.

Referring to FIGS. 8-15, an electrical connector 100' according to a second embodiment of the present invention is disclosed. Structures of the electrical connectors 100, 100' in the first and second embodiments are similar, and difference is that: the contact modules 2 in the first embodiment are different from contact modules 2' in the second embodiment. The electrical connector 100' in the second embodiment also comprises an insulative housing 1', a first shell 3', a second shell 4' and a third shell 5' which are all same to that in the first embodiment. Therefore, the insulative housing 1', the first, second and third shell 3', 4', 5' will not be introduced in the following description, and the contact modules 2' will be described detailedly in the following.

The two contact modules 2' are symmetrical with each other. Each contact module 2' comprises a plurality of contacts 21' and a plurality of insulators 22' insert molded around the contacts 21'. The contacts 21' extend along a height direction of the insulative housing 1', and each has a longest securing portion 212', a contact portion 211' extending upwardly to a tongue 12' of the insulative housing 1', and a tail portion 213' extending downwardly and out of the insulative housing 1'. The contact portions 211' are arranged in two rows and respectively located at two sides of the tongue 12'.

The contact portions 211' in each contact module 2' are arranged in a row and locate at a same side of the tongue 12'. The tail portions 213' in each contact module 2' are arranged in three rows which comprise an outer row closed to the first side wall 14' of the insulative housing 1', a middle row and an inner row. The securing portion 212' comprises a first securing portion 214' directly connecting with the contact portions 211', a second securing portion 215' directly connecting with the tail portion 213' and a connecting portion 216' connecting the first securing portion 214' and the second securing portion 215' together. The first securing portions 214' in each contact module 2' are arranged in a row corresponding to the contact portions 211'. The second securing portions 215' in each contact module 2' are arranged in three rows corresponding to the tail portions 213', and comprise a first row corresponding to the outer row of the tail portions 213', a second row corresponding to the middle row of the tail portions 213' and a third row corresponding to the inner row of the tail portions 213'.

The connecting portion 216' has an upright portion 2161' bending outwardly and downwardly from the first securing portion 214' and parallel to the first securing portion 214', and a bending portion 2162' partly bending inwardly or outwardly from a lower end of the upright portion 2161' to arrange the tail portions 213' in the three rows. The second securing portion 215' comprises a first portion 2151' extending downwardly from the bending portion 2162', a second portion 2152' extending obliquely and downwardly from the first portion 2151' along a same sideward direction, and a third portion 2153' extending downwardly from the second portion 2152' and connecting with the tail portion 213'. The first portions 2151' of the second securing portions 215' in different rows of the same contact module 2' are offset from each other in both a width direction and a thickness direction of the insulator 22'. The first portion 2151' and the second portion 2152' defines an angle therebetween which is different from that in other rows of the same contact module 2', therefore, the contacts 21' in different rows will not contact with each other when the contact portions 211' of a contact module 2' arranged in a row, and will not disturb with each other.

The insulators 22' in each contact module 2' comprise a first insulator 221' insert molded around the first securing portions 214', and a pair of second insulators 222' respectively insert molded around a row or two rows of the second securing portions 215'. A second insulator 222' in the pair is insert molded around the third row of the second securing portions 215', and another second insulator 222' in the pair is insert molded around the first and second rows of the second securing portions 215'. Therefore, the contacts 21' can be fixed in the insulators 22' stably when the contacts 21' are longest and upper portions and lower portions of the contacts 21' are arranged in different rows.

The first insulators 221' of the two contact modules 2' each has an inner face 2211' and an outer face 2212'. Each first insulator 221' has a first post 2213' extending inwardly from the inner face 2211' and a first recess 2214' recessed from the inner face 2212' thereof. The two contact modules 2' are fixed with each other via the post 2213' and the recess 2214' engaging with each other. Each first insulator 221' has a first projection 2215' extending outwardly from the outer face 2212' to engage with the opening 143' of the insulative housing 1' for fixing the first insulator 221' to the receiving space 18'. The first insulator 221' defines at least a groove 2216' recessed from the inner face 2211'. The mold has a plurality of pins (not shown) located at the groove 2216' and arranged between adjacent contacts 2' to separate the contacts 2' from each other, and for preventing the contacts 2' from contacting with each other as filling the melting plastic. Each first insulator 221' has a plurality of ribs 2217' for engaging with an inner side of the first side walls 14' and the second side walls 15' of the insulative housing 1'.

The second insulators 222' of one contact module 2' each has a joint face 2221' engaging with each other. The second insulator 222' has a second post 2222' extending inwardly from the joint face 2221' and a second recess 2223' recessed from the joint face 2221'. The two insulators 222' are fixed with each other via the post 2222' and recess 2223' engaging with each other. The second insulator 222' located at an outer side position has a second projection 2224' extending outwardly from an out side thereof to engage with the opening 143', and a plurality of ribs 2225' extending outwardly from an out side thereof for engaging with an inner side of the first side walls 14' and the second side walls 15' of the insulative housing 1'. In addition, each second insulator 222' has a pair of limiting blocks 2226' at extending outwardly from two sides thereof to abut against a lower end of the insulative housing 1'.

In molding process, insert molding the second insulators 222' around one row or two rows of the second securing portions 215' firstly, the second insulators 222' are formed easily because the contacts 21' insert molded in each second insulator 222' are fewer, and the distance between adjacent contacts 21 are easy to be controlled; secondly, fixing the two insulators 222' together, the contact portions 211' and the first securing portions 214' of the two second insulators 222' are located at a same row along the width direction of the insulative housing 1'. Thirdly, insert molding the first insulator 221' around the first securing portions 214 to form a contact module 2'. Of course, the second insulators 222' can be insert molded around only one row of the second securing portions 215', or two rows of the second securing portions 215' in the other embodiments.

As fully described above, each contact module 2' of the electrical connector 100' is formed via two times insert molding, the contacts 21' with different arrangements at upper portions and lower portions will be fixed stably and can be arranged closely to adapt to the miniature development.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A standing type electrical connector comprising:

an insulative housing associated with a metallic shell commonly defining an upward mating face and a downward mounting face oblique to each other;

a mating port defined in the housing intimately below the mating face;

a mating tongue exposed in said mating port surrounded by the shell;

at least one contact module assembled within the housing and including an insulator insert molded with a plurality of contacts, each of said contacts defining a contact section extending along a first direction and exposed outside of the insulator and assembled onto the mating tongue under condition that the contacting sections of said contacts are coplanar with one another, and a tail section extending along a second direction in a rear portion of the housing and exposed outside of the mounting face;

said first direction is oblique to said second direction;

wherein said insulator includes spaced opposite front and rear pieces, and the rear piece includes two parts staked with each other and respectively retaining corresponding tail sections in at least two different rows.

2. The standing type electrical connector as claimed in claim 1, wherein said insulator defines a front face adjacent to a root region of the mating tongue and parallel to the mating face, and a rear face adjacent to the mounting face and parallel to the mounting face.

3. The standing type electrical connector as claimed in claim 1, wherein the tail section is further equipped with at a distal end a solder region extending either perpendicular or parallel thereto for soldering to a printed circuit board on which said mounting face closely confronts.

4. The standing type electrical connector as claimed in claim 1, wherein the tail sections in one row and corresponding contact sections define an angle which is different from that of the other rows of tail sections and corresponding contact sections.

5. An electrical connector comprising:

an insulative housing having a body portion and a tongue extending from the body portion;

a metal shell covering the insulative housing and forming a receiving opening between the metal shell and the tongue; and a pair of contact modules assembled to the body portion, each contact module having a plurality of contacts and a plurality of insulators insert molded around the contacts, each contact having a contact portion extending to the tongue, a tail portion extending out of the insulative housing, and a securing portion connecting the contact portion and the tail portion together, the contact portions of each contact module being arranged in one row at one side of the tongue, the tail portions of each contact module being arranged in at least two rows, each securing portion having a first securing portion directly connecting with the contact portion and a second securing portion directly connecting with the tail portion, and a connecting portion connecting the first securing portion and the second securing portion together, the first securing portions of each contact module being arranged in one row corresponding to the contact portions, corresponding second securing portions being arranged in at least two rows, each contact module having a first insulator insert molded around the first securing portions, and a pair of second insulators respectively insert molded around the second securing portions;

wherein the second securing portion has a first portion extending downwardly from the connecting portion, a second portion extending obliquely toward a same lateral side and downwardly from the first portion, and a third portion extending downwardly from the second portion, the first portions of the second securing portions in different rows of each contact module are offset from each other in both a width direction and a thickness direction of the second insulator.

6. The electrical connector as claimed in claim 5, wherein the body portion defines a mating wall facing the receiving opening, a receiving space surrounded by a plurality of side walls extending from the mating wall to receive the contact modules, and a plurality of passageways communicating the receiving opening and the receiving space.

7. The electrical connector as claimed in claim 6, wherein the body portion has an outstanding portion extending outwardly from the mating wall, and the tongue extends from a middle position of the outstanding portion.

8. The electrical connector as claimed in claim 5, wherein the tail portions of each contact module are arranged in three rows, and the second securing portions are arranged in three rows corresponding to the tail portions, one of the second insulators in each contact module is insert molded around one row of the second securing portions, and the other second insulator of the contact module is insert molded around the other two rows of the second securing portions.

9. The electrical connector as claimed in claim 8, wherein each second insulator has a joint face, a pair of limiting blocks extending outwardly from two sides thereof to abut against a lower end of the insulative housing, a post extending inwardly from the joint face and a second recess recessed from the joint face to engage with the other second insulator.

10. The electrical connector as claimed in claim 8, wherein the connecting portion comprises an upright portion bending outwardly and downwardly from the first securing portion, and a bending portion extending inwardly or outwardly from a lower end of the upright portion.

11. The electrical connector as claimed in claim 10, wherein the first portion extends downwardly from the bending portion, and the first portions and the second portions in one row of the second securing portions define an angle which is different from that of the other rows of the second securing portions.

12. The electrical connector as claimed in claim 11, wherein the tail portions extend downwardly from the third portions, and two adjacent rows of tail portions are spaced from each other along both the width direction and the thickness direction.

* * * * *